US010000959B2

(12) United States Patent
Uno

(10) Patent No.: US 10,000,959 B2
(45) Date of Patent: Jun. 19, 2018

(54) VEHICLE DOOR OPENING AND CLOSING CONTROL DEVICE

(71) Applicant: NABTESCO CORPORATION, Tokyo (JP)

(72) Inventor: Hiroki Uno, Kobe (JP)

(73) Assignee: NABTESCO CORPORATION, Tokyo (JP)

( * ) Notice: Subject to any disclaimer, the term of this patent is extended or adjusted under 35 U.S.C. 154(b) by 0 days. days.

(21) Appl. No.: 15/025,057

(22) PCT Filed: Sep. 16, 2014

(86) PCT No.: PCT/JP2014/074403

§ 371 (c)(1),
(2) Date: Mar. 25, 2016

(87) PCT Pub. No.: WO2015/045953

PCT Pub. Date: Apr. 2, 2015

(65) Prior Publication Data

US 2016/0215554 A1 Jul. 28, 2016

(30) Foreign Application Priority Data

Sep. 26, 2013 (JP) ..... 2013-200089

(51) Int. Cl.
*B61D 19/00* (2006.01)
*E05F 15/60* (2015.01)
(Continued)

(52) U.S. Cl.
CPC ..... *E05F 15/60* (2015.01); *B61D 19/00* (2013.01); *B61D 19/02* (2013.01); *E05F 15/635* (2015.01);
(Continued)

(58) Field of Classification Search
CPC ..... B61D 19/00
See application file for complete search history.

(56) References Cited

U.S. PATENT DOCUMENTS 5,804,937 A * 9/1998 Sasajima ..... E05F 15/632 318/259
5,892,340 A * 4/1999 Sasajima ..... B60R 16/027 318/286
(Continued)

FOREIGN PATENT DOCUMENTS

CN 101368465 A 2/2009
CN 102852424 A 1/2013
(Continued)

OTHER PUBLICATIONS

Notification of Reasons for Rejection as issued in Taiwanese Patent Application No. 103133082, dated Nov. 16, 2016.
(Continued)

*Primary Examiner* — Truc M Do
(74) *Attorney, Agent, or Firm* — Pillsbury Winthrop Shaw Pittman, LLP

(57) ABSTRACT

A vehicle door is operated in accordance with a desired speed pattern.
A vehicle door opening-closing control device 1 includes a power-supply voltage detecting unit 2 that outputs a detection value of a power-supply voltage of an electric motor 13, a reference control pattern storage unit 3 that stores a reference control pattern that indicates a voltage command value or a speed command value for the electric motor 13, the reference control pattern is a control pattern of the electric motor when the detection value is within a predetermined range, a control pattern generating unit 4*a* that generates a corrected control pattern that is obtained by correcting the reference control pattern based on the detec-
(Continued)

tion value, and a PWM control unit 4 that controls the electric motor 13 based on the corrected control pattern.

7 Claims, 8 Drawing Sheets

(51) Int. Cl.
*B61D 19/02* (2006.01)
*E05F 15/635* (2015.01)

(52) U.S. Cl.
CPC ..... *E05Y 2201/62* (2013.01); *E05Y 2201/716* (2013.01); *E05Y 2201/722* (2013.01); *E05Y 2400/36* (2013.01); *E05Y 2400/40* (2013.01); *E05Y 2900/51* (2013.01)

(56) References Cited

U.S. PATENT DOCUMENTS 6,134,836 A 10/2000 Kawanobe et al.
6,164,015 A * 12/2000 Kawanobe ..... E05F 15/646 49/360
6,208,102 B1 * 3/2001 Kikuchi ..... G05B 19/416 318/282
6,226,925 B1 * 5/2001 Shimura ..... E05F 15/646 49/139
2002/0093301 A1 * 7/2002 Itami ..... G05B 19/40 318/452
2003/0225497 A1 * 12/2003 Whinnery ..... G05B 19/232 701/49
2005/0057203 A1 * 3/2005 Shimizu ..... H01H 3/0213 318/268
2005/0179409 A1 * 8/2005 Honma ..... G01P 3/489 318/62
2005/0275363 A1 * 12/2005 Honma ..... E05F 15/659 318/280
2005/0288840 A1 * 12/2005 Suzuki ..... B60J 7/0573 701/49
2007/0266635 A1 * 11/2007 Sugiura ..... E05F 15/632 49/27
2008/0178422 A1 * 7/2008 Imai ..... B60J 5/06 16/57
2008/0180236 A1 * 7/2008 Bosse ..... B60J 7/0573 340/455
2009/0100758 A1 * 4/2009 Nagakura ..... E05F 17/00 49/334
2011/0043157 A1 * 2/2011 Yuasa ..... B60N 2/0232 318/599
2012/0001585 A1 * 1/2012 Holzinger ..... G05B 19/416 318/696

FOREIGN PATENT DOCUMENTS

JP 2005-139899 A 6/2005
JP 2006-083526 A 3/2006
JP 2006-214148 A 8/2006
JP 3953491 B2 8/2007
JP 2007-262750 A 10/2007
JP 2012-176708 A 9/2012
KR 10-1201357 B1 11/2012
TW 548148 B 8/2003

OTHER PUBLICATIONS

International Search Report as issued in International Patent Application No. PCT/JP2014/074403, dated Nov. 4, 2014.
International Preliminary Report on Patentability as issued in International Patent Application No. PCT/JP2014/074403, dated Apr. 7, 2016.
Office Action as issued in Taiwanese Patent Application No. 103133082, dated Mar. 25, 2016.
Extended European Search Report as issued in European Patent Application No. 14849539.3, dated Apr. 21, 2017.
First Notification of Opinions of the Examination as issued in Chinese Patent Application No. 201480052958.3, dated Feb. 28, 2017.

* cited by examiner

VEHICLE DOOR OPENING AND CLOSING CONTROL DEVICE

CROSS-REFERENCE TO RELATED APPLICATIONS

This application is the U.S. National Stage of PCT/JP2014/074403, filed on Sep. 16, 2014, which claims priority to Japanese Patent Application No. 2013-200089, filed on Sep. 26, 2013. The contents of these applications are incorporated herein by reference in their entireties.

TECHNICAL FIELD

The present invention relates to a vehicle door opening-closing control device that controls opening and closing of a door of a vehicle.

BACKGROUND

A vehicle door opening-closing control device that controls opening and closing of a door(s) of vehicles has been known. For instance, a door driving control device disclosed in Patent Document 1 identifies each of a plurality of doors and their positions and drives them individually. More specifically, when a driving speed of a door is below a predetermined value, a torque used for driving a door to be opened and closed is switched to a higher torque to perform opening and closing of the door. At this point, the door driving control device sets a door high-powered time window for each door such that the time window in which a door is opened and closed by using the high torque does not overlap between doors or between predetermined sets of the doors. The high-torqued powered opening and closing of a door is performed only in the corresponding door high-powered time window.

RELEVANT REFERENCES

List of Relevant Patent Literature

Patent Literature 1: Japanese Patent Application Publication No. 2007-262750

SUMMARY

Meanwhile, in order to operate a door of a vehicle in accordance with a desired speed pattern, a rotational speed of an electric motor when the electric motor is operated may be fed back to the control device and a duty ratio of a voltage applied to the electric motor may be adjusted. However, in a case of a railroad car and the like, for example, power supplied to the electric motor from an overhead line often fluctuates and when a sufficient power is not supplied to the electric motor from the overhead line, a power source for the electric motor is changed from the overhead line to other power supply (for example, a battery or the like). When there is such a power fluctuation or power source change, a steep rising control occurs in order to maintain a normal opening-closing speed of a door, and may result in overshoot. This means that the opening and closing speed of the door largely deviates from a desired speed pattern. Even in the case of vehicles other than the railroad cars, the opening and closing speeds of a door may deviate from a desired speed pattern due to fluctuation of power supplied to a motor or due to a power source change.

In view of the above, one object of the invention is to operate a door(s) of a vehicle in accordance with a desired speed pattern.

(1) Provided is a vehicle door opening-closing control device that controls opening and closing of a door of a vehicle using an electric motor. The vehicle door opening-closing control device includes a power-supply voltage detecting unit outputting a detection value of a power-supply voltage of the electric motor; a reference control pattern storage unit storing a reference control pattern that indicates a voltage command value or a speed command value for the electric motor, the reference control pattern is a control pattern of the electric motor when the detection value is within a predetermined range; a control pattern generating unit generating a corrected control pattern that is obtained by correcting the reference control pattern based on the detection value; and a PWM control unit controlling the electric motor based on the corrected control pattern.

In the above-described configuration, the PWM control unit controls the electric motor. More specifically, the PWM control unit controls behavior of the electric motor by adjusting electric power supplied to the electric motor.

In this configuration, a control pattern is used for controlling the electric motor. More specifically, as the control pattern, used is a corrected control pattern generated by correcting the reference control pattern which is used when the detection value is within a predetermined range based on the detection value corresponding to the voltage detected by the power-supply voltage detecting unit. In this way, it is possible to control the electric motor such that a difference of speed of the electric motor from a desired pattern caused by voltage fluctuation is reduced before the difference is increased. Consequently, it is possible to bring the opening/closing speed of the door close to desired speed patterns.

As a result, according to the configuration, it is possible to operate a door(s) of a vehicle in accordance with a desired speed pattern.

(2) It is preferable that the power-supply voltage detecting unit output a set voltage value as the detection value. The set voltage value is specified for each power-supply region between two adjacent voltage threshold values among a plurality of voltage threshold values. The control pattern generating unit corrects the reference control pattern such that a value of the reference control pattern is reduced when the detection value is larger than a reference voltage value of the power-supply voltage, and corrects the reference control pattern such that a value of the reference control pattern is increased when the detection value is smaller than the reference voltage value.

In the above-described configuration, the detection value output by the power-supply voltage detecting unit is set to one of the set voltage values which are discreet values. By adequately setting an increment for the set voltage values, a normal control can be applied when the fluctuation in the power supply voltage is small and does not largely affect the speed of the electric motor. Therefore it is possible to reduce a burden on the voltage command pattern generating unit. Whereas when the power-supply voltage largely fluctuates, it is possible to make the actual speed of the electric motor follow a desired motor speed pattern by controlling the electric motor depending on the amount of the fluctuation.

(3) It is also preferable that a hysteresis width that is a width at least from the voltage threshold value to a value smaller than the voltage threshold value be set, and when a detected voltage value is within the hysteresis width, the power-supply voltage detecting unit output, as the detection value, the set voltage value set for the power-supply region that includes a most recent voltage value from among voltage values outside the hysteresis width.

In the above-described configuration, it is possible to reduce a fluctuation in the detection value that occurs when the voltage value detected by the power-supply voltage detecting unit goes up and down around the voltage threshold value. Therefore the control system in this configuration can be stabilized.

(4) It is preferable that the control pattern generating unit correct the reference control pattern by multiplying the reference control pattern by a value that is obtained by dividing the reference voltage value by the detection value.

In the above-described configuration, a voltage command value or speed command value at each time point of the reference control pattern is multiplied by a value that is obtained by dividing the reference voltage value by the detection value. In this manner, the corrected control pattern can be adequately obtained.

(5) It is also preferable that the power-supply voltage detecting unit output, as the detected value, a value based on a moving average of a voltage value.

In the above-described configuration, it is possible to reduce a fluctuation in the detection value caused by instantaneous change of the power supply voltage that does not largely affect the speed of the electric motor. Therefore it is possible to stably operate the electric motor in accordance with a desired speed pattern.

Advantages

According to the aspect of the invention, it is possible to operate a door(s) of a vehicle in accordance with a desired speed pattern.

DESCRIPTION OF THE PREFERRED EMBODIMENTS

The embodiments of the present invention will now be described with reference to the drawings. Note that a door opening-closing control unit or a vehicle door opening-closing control device according to one embodiment of the invention is not limited to hereunder-described embodiment and examples but may be applied to various vehicle door opening-closing control devices that control opening and closing of a vehicle door(s). Note that the term "railroad" is used herein in a broad sense and may encompasses not only a railway in which a car moves on two iron rails but also other means of transportation (a monorail and the like) using vehicles to which electric power is supplied from an overhead line and which travel as guided along a guideway such as a guide track other than the two iron rails.

Structure of Door and Door Opening-Closing Mechanism

Figure 1:
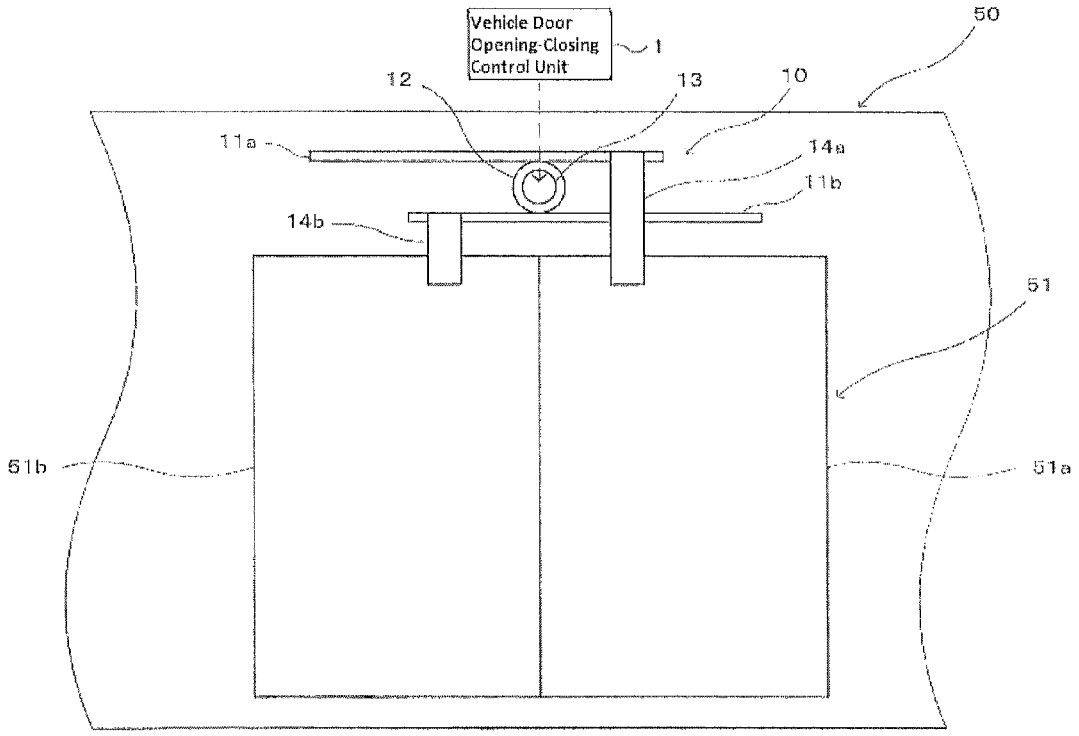
FIG. 1 schematically illustrates structures of a door of a railroad car and a door opening-closing driving mechanism.

Before describing a door opening-closing control unit 1 (a vehicle door opening-closing control device) according to one embodiment of the invention, a door opening-closing driving mechanism 10 activated by the door opening-closing control unit 1 and a door 51 opened and closed by the door opening-closing driving mechanism 10 will be firstly described. FIG. 1 schematically illustrates structures of the door 51 and the door opening-closing driving mechanism 10. Although the door opening-closing control unit 1 is situated outside a railroad vehicle 50 in FIG. 1, this is for the sake of clarity of illustration and the door opening-closing control unit 1 is actually provided in the vehicle 50.

The door 51 illustrated in FIG. 1 may be configured as a separate-sliding type door set that opens and closes an entrance formed on a side wall of the railroad vehicle 50, The door 51 includes a pair of sliding doors 51*a*, 51*b* that are slid to left and right respectively to be apart from each other when the door 51 is opened. The door opening-closing driving mechanism 10 may be attached to the door 51. The door opening-closing driving mechanism 10 may include a pair of racks 11*a*, 11*b*, a pinion 12, and an electric motor 13 as illustrated in FIG. 1.

The pair of racks 11*a*, 11*b* may extend horizontally and may be situated over the sliding doors 51*a*, 51*b* with a predetermined gap interposed between the racks 11*a*, 11*b* in the vertical direction. The rack 11*a* may be fixed over the sliding door 51*a* through a connecting member 14*a* and the rack 11*b* may be fixed over the sliding door 51*b* through a connecting member 14*b*.

The pinion 12 may be provided in a space formed between the pair of racks 11*a*, 11*b* in the vertical direction. The pinion 12 may mesh with teeth of the pair of racks 11*a*, 11*b*.

The electric motor 13 may be provided above the door 51. In this embodiment, the electric motor 13 may be an alternate-current brushless motor. An output shaft (not shown) of the electric motor 13 may be fixed at the center of the pinion 12. In this way, the electric motor 13 can rotate the pinion 12.

In the door opening-closing driving mechanism 10, the electric motor 13 may be powered by a power supply 20 (not shown in FIG. 1) and may be activated by the door opening-closing control unit 1 which will be later described in detail. When the output shaft of the electric motor 13 rotates in a clockwise direction in FIG. 1, the pinion 12 is rotated in the clockwise direction. As a result, the pair of racks 11*a*, 11*b* are moved horizontally away from each other so that the sliding doors 51*a*, 51*b* are separated from each other and the door is opened. Whereas when the output shaft of the electric motor 13 rotates in a counterclockwise direction, the pinion 12 is rotated in the counterclockwise direction. As a result, the pair of racks 11*a*, 11*b* are moved horizontally to be brought close to each other and the door is closed.

Note that the invention may be applied to various door opening-closing driving mechanisms in addition to the above-described door opening-closing driving mechanism 10 that includes the pair of racks 11*a*, 11*b* and the pinion 12.

For example, the invention can also be applied to a door opening-closing driving mechanism that includes a pulley and belt.

Configuration of Door Opening-Closing Control Unit

Figure 2:
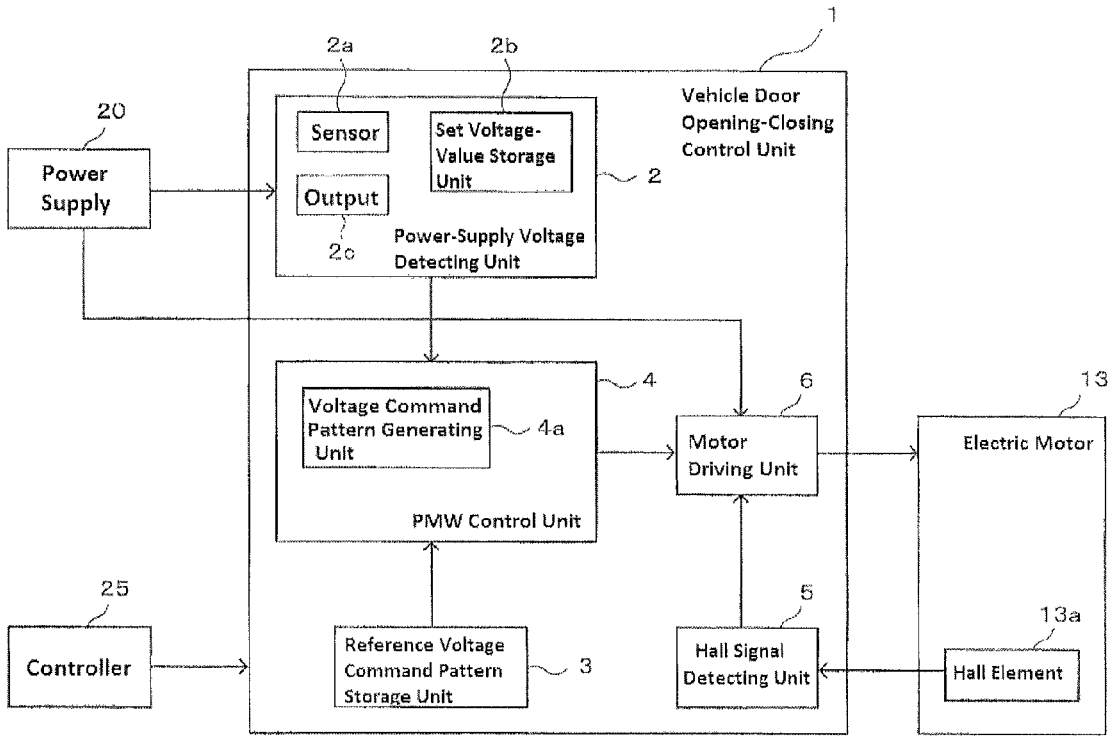
FIG. 2 is a block diagram illustrating a door opening-closing control unit according to one embodiment of the invention.

FIG. 2 is a block diagram illustrating the door opening-closing control unit 1 according to the embodiment. The door opening-closing control unit 1 may be configured to control a rotational position of the electric motor 13 based on an instruction from a controller 25 that instructs opening and closing of the door 51 in order to control an opening/closing position of the door 51. The door opening-closing control unit 1 may include a power-supply voltage detecting unit 2, a reference voltage command pattern storage unit 3 (a reference control pattern storage unit), a PWM control unit 4, a Hall signal detecting unit 5, and a motor driving unit 6.

The power-supply voltage detecting unit 2 may be configured to detect a voltage value of the power supply 20 and output a voltage value corresponding to the detected voltage value as a detection value. The power-supply voltage detecting unit 2 may include a sensor 2*a*, a set voltage-value storage unit 2*b*, and an output unit 2*c*. The power supply 20 may include a power unit (not shown) that converts an alternating-current voltage supplied from an overhead line to a constant direct-current voltage, and a battery (not shown). The power unit is normally used as the power supply 20 but when there is some trouble in supplying power from the overhead line, the battery may be used as the power supply 20.

The sensor 2*a* may detect a voltage value of the power supply 20. In the embodiment, the sensor 2*a* may estimate a moving average of the power supply 20 as an average value and output the average value as the voltage value of the power supply 20.

The set voltage-value storage unit 2*b* may store a plurality of set voltage values which are discrete voltage values corresponding to the values detected by the sensor 2*a*. In the embodiment, the set voltage values may be incremented by 10 volts (V), for example, the set voltage values may be 80 V, 90 V, 100 V and the like.

Figure 3:
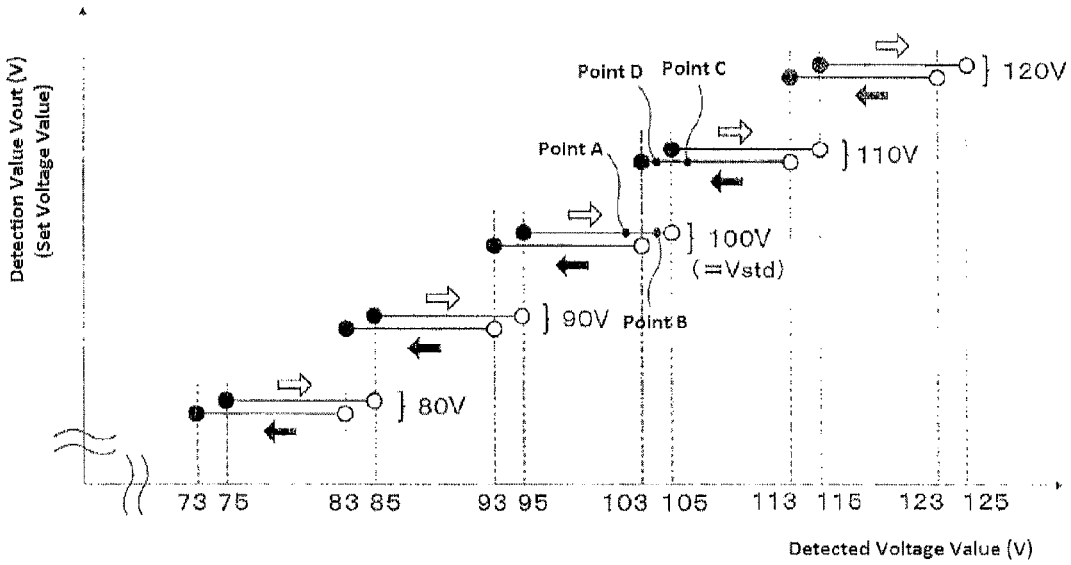
FIG. 3 is a chart illustrating a relationship between a voltage value detected by a sensor and a detection value output from an output unit in a power-supply voltage detecting unit.

The output unit 2*c* may output a value (the set voltage value) corresponding to the voltage value detected by the sensor 2*a*. FIG. 3 is a chart illustrating a relationship between the voltage value detected by the sensor 2*a* and the detection value output from the output unit 2*c* in the power-supply voltage detecting unit 2.

Referring to the chart of FIG. 3, a plurality of voltage threshold values (75 volts (V), 85 volts (V), . . . ) are set. In the chart of FIG. 3, a region between two adjacent voltage threshold values (75 V and 85 V, 85 V and 95 V, . . . ) may be defined as a power-supply region (a region ranging from 75 V up to but not including 85 V, a region ranging from 85 V up to but not including 95 V, . . . ). The above-described set voltage values are each set so as to correspond to the power-supply regions respectively. More specifically, 80 V of the set voltage value corresponds to the power-supply region ranging from 75 V up to but not including 85 V, and 90 V of the set voltage value corresponds to the power-supply region ranging from 85 V up to but not including 95 V.

In the chart of FIG. 3, a lower threshold value which is equal to or smaller than the voltage threshold value and an upper threshold value which is equal to or larger than the voltage threshold value are set for each voltage threshold value. In the embodiment, the lower threshold value is 2 V smaller than each voltage threshold value, and the upper threshold value is same as each voltage threshold value. In this manner, a hysteresis width, that is a voltage width from the voltage threshold value to the lower threshold value, is set to 2 V for each voltage threshold value.

When the detected voltage value is within the above-described hysteresis width, the output unit 2*c* may output, as the detection value, the set voltage value corresponding to the power-supply region that includes the most recent voltage value from among the voltage values that are outside the hysteresis width.

More specifically, when a voltage of the power supply 20 increases and is situated within the hysteresis width, for example, when the voltage increases from the point A (102 V) to the point B (104 V) in FIG. 3, the power-supply voltage detecting unit 2 outputs 100 V as the detection value. When the voltage of the power supply further increases to the upper limit (105 V) or higher, the power-supply voltage detecting unit 2 outputs 110 V as the detection value.

Whereas when a voltage of the power supply 20 decreases and is situated within the hysteresis width, for example, when the voltage decreases from the point C (106 V) to the point D (104 V) in FIG. 3, the power-supply voltage detecting unit 2 outputs 110 V as the detection value. When the voltage of the power supply further decreases to below the lower limit (103 V), the power-supply voltage detecting unit 2 outputs 100 V as the detection value.

When the above-described hysteresis width is set, the detection value may be different depending on the direction (increase or decrease) of the voltage value even when the voltage of the power supply 20 is same. In this manner, it is possible to reduce fluctuation of the detection value (so-called hunting) that may occur when the voltage goes up and down around the voltage threshold value. Consequently, the control system in the door opening-closing control unit 1 can be stabilized.

The reference voltage command pattern storage unit 3 may be provided in, for example, memory of a microcomputer circuit (not shown). The reference voltage command pattern storage unit 3 stores a reference voltage command pattern (reference control pattern) that is used for controlling a speed of opening and closing of the door 51 according to a predetermined speed pattern.

Figure 4A:
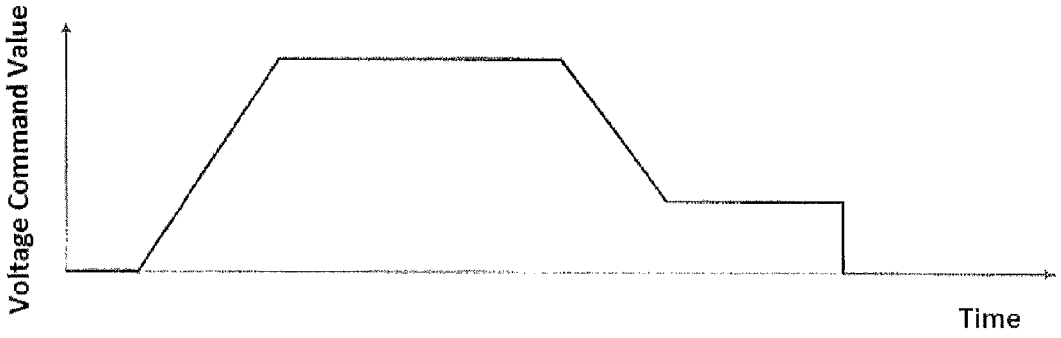
FIG. 4*a* is a chart illustrating an example of a voltage command pattern.
Figure 4B:
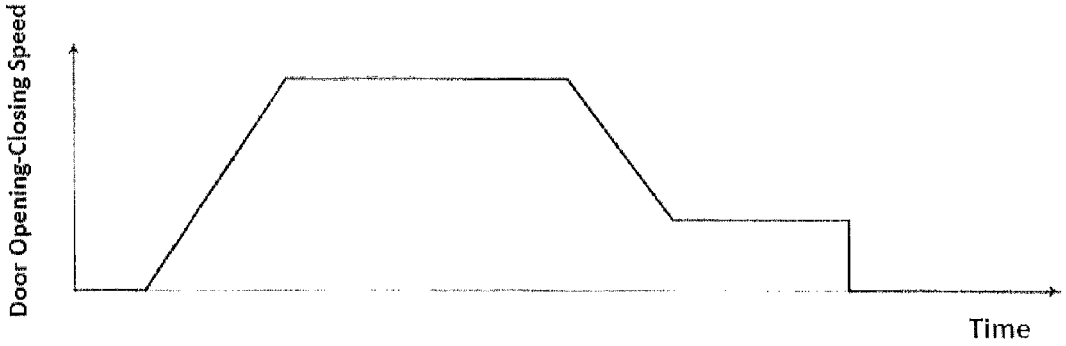
FIG. 4*b* is a chart illustrating an example of a door opening-closing speed pattern.

FIG. 4*a* is a chart illustrating an example of a voltage command pattern stored in the reference voltage command pattern storage unit 3. FIG. 4*b* is a chart illustrating an example of a door opening-closing speed pattern of the door 51 that is opened or closed by the door opening-closing control unit 1 according to the embodiment. In the embodiment, the reference voltage command pattern storage unit 3 stores a reference voltage command pattern that is a voltage command pattern used when the power supply voltage is within a predetermined range including a predetermined reference voltage value (100 V in the embodiment). The reference voltage command pattern is specified in advance through experiments such that the speed of opening and closing of the door shows a desired speed pattern illustrated in FIG. 4*b* when the power supply voltage is within the predetermined range.

The PWM control unit 4 may be provided in, for example, a CPU of a microcomputer circuit (not shown). The PWM control unit 4 is configured to control a duty ratio of a voltage applied to the electric motor 13 based on the reference voltage command pattern stored in the reference voltage command pattern storage unit 3 and the detection value detected by the power-supply voltage detecting unit 2. The PWM control unit 4 may include a voltage command pattern generating unit 4*a* (a control pattern generating unit). Note that the duty ratio of the voltage is obtained by dividing a pulse width T by a period T wherein the voltage is represented as pulsed waves with the period T.

Figure 5:
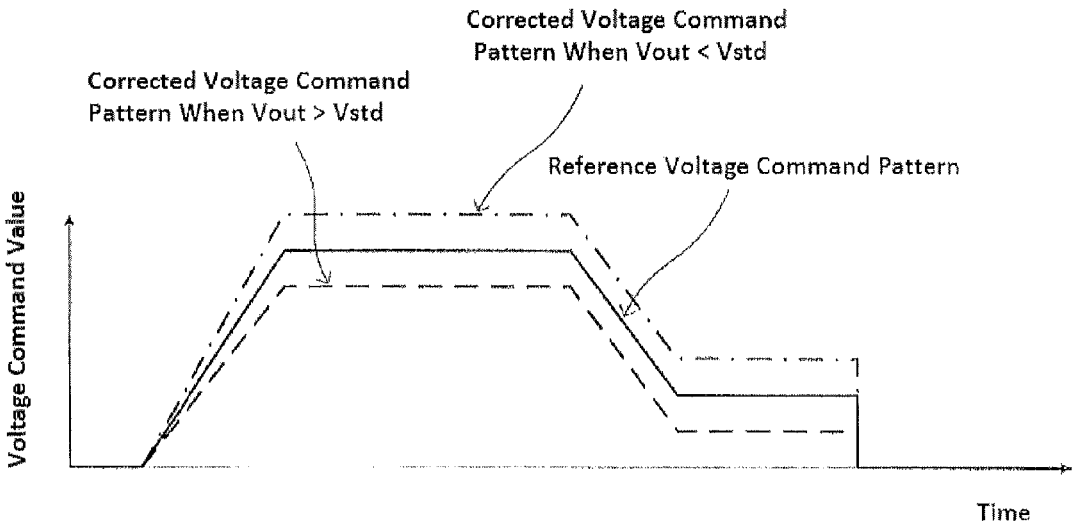
FIG. 5 is a chart for explaining a corrected voltage command pattern generated by a voltage command pattern generating unit.

FIG. 5 is a chart for explaining a corrected voltage command pattern generated by the voltage command pattern generating unit 4*a*. The voltage command pattern generating unit 4*a* may generate a corrected voltage command pattern (corrected control pattern) by correcting the reference voltage command pattern based on the detection value detected by the power-supply voltage detecting unit 2. More specifically, in order to generate a corrected voltage command pattern, the voltage command pattern generating unit 4*a* may multiply a voltage command value at each time point of the reference voltage command pattern by a value that is obtained by dividing the reference voltage value Vstd (100 V) by the detection value Vout (=Vstd/Vout). The voltage command pattern generating unit 4*a* may store the generated corrected voltage command pattern. For example, when the detection value Vout is larger than the reference voltage value Vstd, the corrected voltage command pattern may have the pattern denoted in the dashed line in FIG. 5. Whereas when the detection value Vout is smaller than the reference voltage value Vstd, the corrected voltage command pattern may have the pattern denoted in the dashed-dotted line in FIG. 5.

Each time a detection value is output by the power-supply voltage detecting unit 2, the voltage command pattern generating unit 4*a* may generate a corrected voltage command pattern based on the detection value. The voltage command pattern generating unit 4*a* may replace the stored corrected voltage command pattern by a newly generated corrected voltage command pattern.

The PWM control unit 4 may control the duty ratio of the voltage based on the corrected voltage command pattern generated by the voltage command pattern generating unit 4*a*. More specifically, the PWM control unit 4 may gradually increase the duty ratio when the voltage command value of the corrected voltage command pattern increases over time. Whereas when the voltage command value decreases over time, the PWM control unit 4 may gradually decrease the duty ratio. When the voltage command value is constant, the PWM control unit 4 may maintain the duty ratio as of the start time of this time window.

The Hall signal detecting unit 5 may detect a rotational position of the electric motor 13 using a Hall element 13*a* provided in the electric motor 13.

Figure 6:
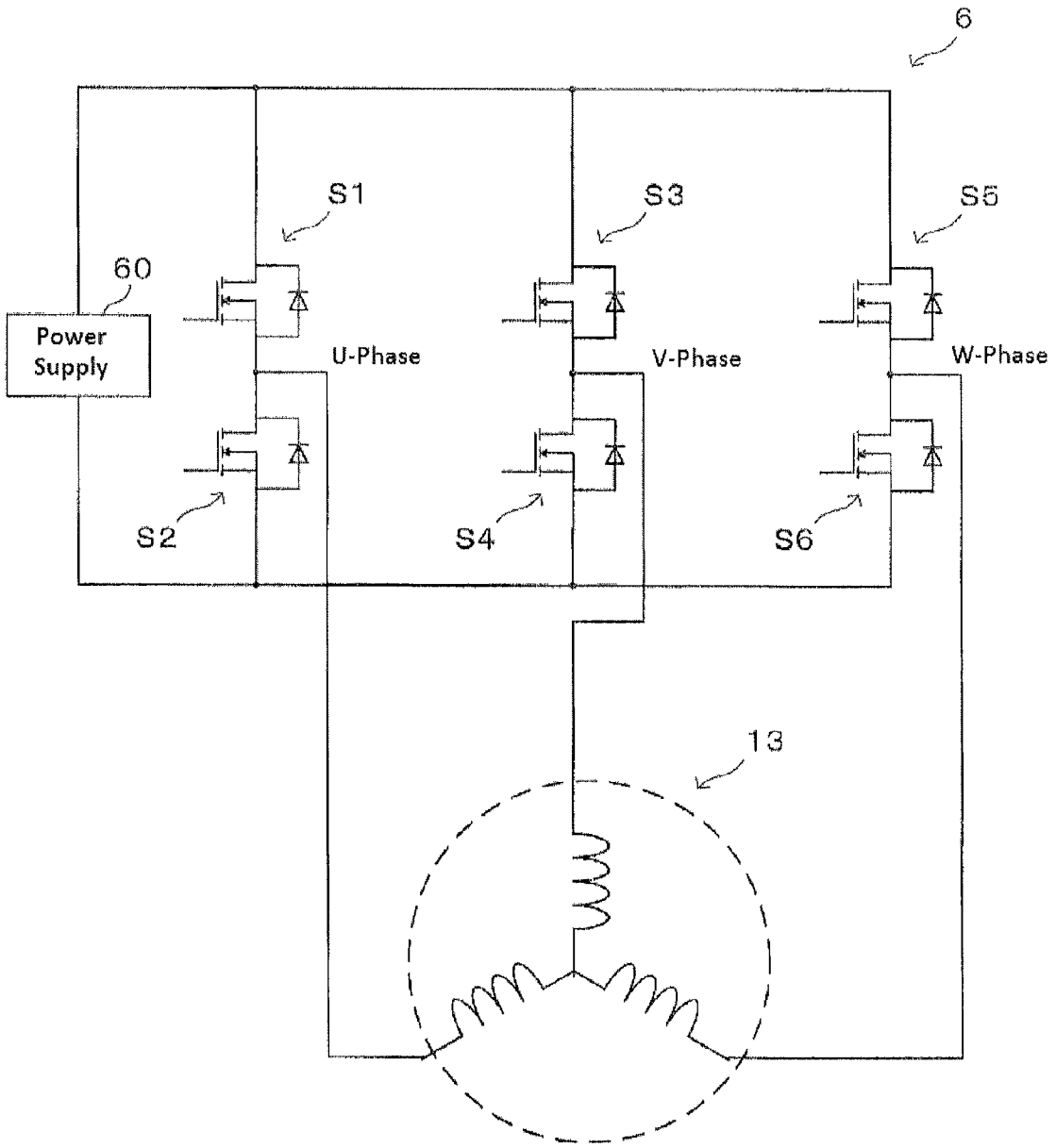
FIG. 6 is a circuit diagram illustrating a configuration of a motor driving unit together with an electric motor.

FIG. 6 is a circuit diagram illustrating a configuration of a motor driving unit 6. Referring to FIG. 6, six switching elements S1-S6 are coupled to each other in the motor driving unit 6. In the motor driving unit 6, switching of switching elements S1-S6 are adequately performed depending on commands from the controller 25, the duty ratio set by the PWM control unit 4, the rotational position of the electric motor 13 detected by the Hall signal detecting unit 5 and the like. In this way, rotational driving of the electric motor 13 is adequately performed and consequently the door 51 is opened and closed in accordance with the desired door opening-closing speed pattern shown in FIG. 4*b*.

Operation of Door Opening-Closing Control Unit

Figure 7:
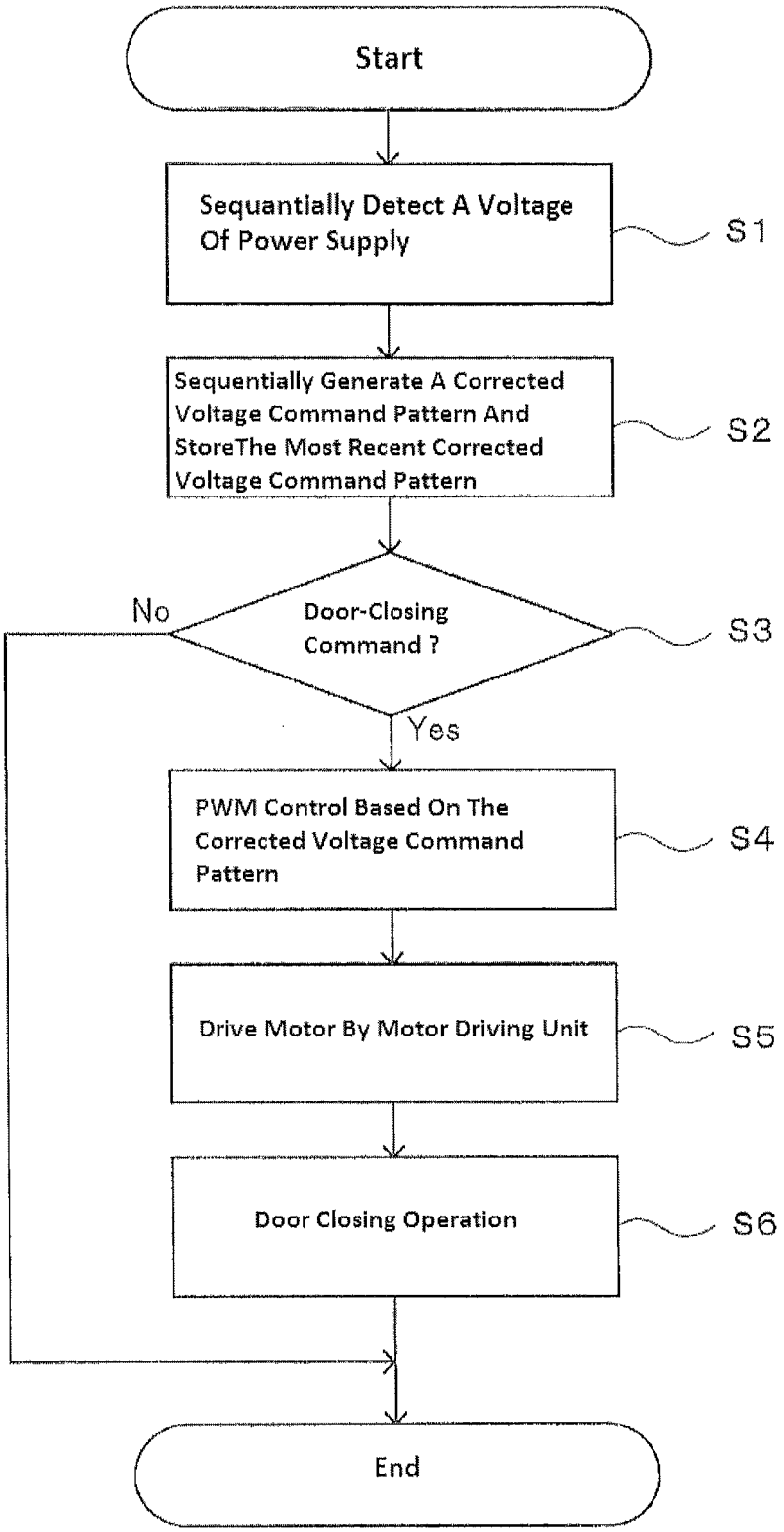
FIG. 7 is a flow chart for describing operations of the door opening-closing control unit of FIG. 2.

FIG. 7 is a flow chart for describing operations of the door opening-closing control unit 1. A closing operation of the door 51 will be now described with reference to FIG. 7. As for an opening operation of the door 51 is substantially same as the closing operation illustrated in FIG. 7 except that a door closing command in Step S3 is replaced by a door opening command, and a door closing action in Step S6 is replaced by a door opening action. Therefore description of the opening operation will be hereunder omitted.

The power-supply voltage detecting unit 2 may perform detection of a voltage of the power supply 20 (Step S1) and sequentially output the detection value to the PWM control unit 4. In the PWM control unit 4, the voltage command pattern generating unit 4*a* may generate a corrected voltage command pattern based on the detection value output by the power-supply voltage detecting unit 2. The voltage command pattern generating unit 4*a* may store a latest corrected voltage command pattern from among the generated corrected voltage command patterns (Step S2).

When the PWM control unit 4 receives a command to close the door 51 from the controller 25 (Yes in Step S3), the PWM control unit 4 may control a duty ratio of a voltage applied to the motor driving unit 6 based on the corrected voltage command pattern stored at the time in the voltage command pattern generating unit 4*a* (Step S4). The motor driving unit 6 adequately drives and rotates the electric motor 13 based on the duty ratio of the voltage controlled by the PWM control unit 4, the rotational position of the electric motor 13 detected by the Hall signal detecting unit 5 and the like (Step S5). In this manner, the door 51 may be closed in accordance with the desired speed pattern (Step S6). When the PWM control unit 4 does not receive the command to close the door 51 from the controller 25 (No in Step S3), the above-described Steps S4-S6 are not performed and the current flow is ended and a new flow starts again from Step S1.

Advantageous Effects

As described above, in the door opening-closing control unit 1 according to the embodiment, the PWM control unit 4 controls the electric motor. More specifically, the PWM control unit 4 controls a duty ratio of voltage applied to the electric motor 13 based on the voltage command pattern. The motor driving unit 6 drives the electric motor 13 based on the duty ratio controlled by the PWM control unit 4. In this way, behavior of the electric motor 13 is controlled by adjusting electric power supplied to the electric motor 13.

In the door opening-closing control unit 1, the voltage command pattern is used for controlling the duty ratio of the voltage. More specifically, the voltage command pattern is a corrected pattern generated by correcting, based on the detection value corresponding to the voltage detected by the power-supply voltage detecting unit 2, the reference voltage command pattern which is used when the voltage is within a predetermined voltage range including the reference voltage value, and this corrected pattern (corrected voltage command pattern) is used.

Generally, electric power consumed by the door opening-closing control unit 1 in a railroad car is supplied from an overhead line. Accordingly, a voltage applied to the door opening-closing control unit 1 tends to fluctuate. Furthermore, if any trouble occurs in an electric power supply system that supplies power to the door opening-closing control unit 1 in the railroad car from the overhead line, a battery instead supplies electric power to the door opening-closing control unit 1. The voltage largely fluctuates when such a switching of the power source occurs.

Conventionally a revolution speed of the electric motor was detected and the duty ratio was controlled based on the detected revolution speed. However, in this case, a steep rise control occurs in order to maintain the opening and closing speed of the door when a voltage applied to the door opening-closing control unit largely fluctuate as described above. Consequently overshoot could occur and the opening and closing speeds largely deviate from a desired speed pattern.

Whereas in the door opening-closing control unit 1 according to the embodiment, the duty ratio of the voltage is controlled based on the corrected voltage command pattern as described above. In this way, it is possible to control the duty ratio of the voltage such that a difference of speed of the electric motor 13 from a desired pattern caused by the voltage fluctuation of the power supply 20 is reduced before the difference is increased. Consequently, it is possible to bring the opening/closing speed of the door 51 close to desired speed patterns.

As a result, the door opening-closing control unit 1 is able to operate a door(s) of a vehicle in accordance with a desired speed pattern.

Moreover, in the door opening-closing control unit 1, the detection value output by the power-supply voltage detecting unit 2 is set to one of the set voltage values which are discreet values. By adequately setting an increment for the set voltage values, a normal control can be applied when the fluctuation in the power supply voltage is small and does not largely affect the speed of the electric motor 13. Therefore it is possible to reduce a burden on the voltage command pattern generating unit 4*a*. When the voltage of the power supply 20 largely fluctuates, it is possible to make the actual speed of the electric motor follow a desired motor speed pattern by changing the duty ratio depending on the amount of the fluctuation.

Furthermore, according to the door opening-closing control unit 1, it is possible to reduce a fluctuation in the detection value that occurs when the voltage value detected by the power-supply voltage detecting unit 2 goes up and down around the voltage threshold value. Therefore the control system in this configuration can be stabilized.

Moreover, in the door opening-closing control unit 1, a voltage command value at each time point of the reference voltage command pattern is multiplied by a value that is obtained by dividing the reference voltage value by the detection value. In this manner, the corrected voltage command pattern can be adequately obtained.

Furthermore, the door opening-closing control unit 1 detects a voltage value of the power supply 20 by estimating a moving average of the voltage value. In this manner, it is possible to reduce a fluctuation in the detection value caused by instantaneous change of the power supply voltage that does not largely affect the speed of the electric motor 13. Therefore it is possible to stably operate the electric motor 13 in accordance with a desired speed pattern.

Although the embodiments of the present invention have been described above, the present invention is not restricted to the above-described embodiments, and various modifications are possible within the scope of the claims. For example, the following exemplary variation is possible.

(1) In the above-described embodiment, the upper threshold value and the lower threshold value are set for each voltage threshold value, and the upper threshold value may be set to a value equal to or larger than the voltage threshold value and the lower threshold value may be set to a value smaller than the voltage threshold value. Alternatively the upper threshold value may be set to a value larger than the voltage threshold value and the lower threshold value may be set to a value equal to or smaller than the voltage threshold value. Alternatively the upper threshold value and the lower threshold value may be set to the same as the corresponding voltage threshold value to make the hysteresis width zero.

(2) In the above-described embodiment, the reference voltage command pattern storage unit 3 that stores the reference voltage command pattern which is the reference control pattern and the voltage command pattern generating unit 4*a* are provided, however the invention is not limited to this configuration. More specifically, instead, a motor speed command pattern storage unit that stores a motor speed command pattern which is the reference control pattern and a motor speed command pattern generating unit may be provided. This configuration can also produce the same effect as the above-described embodiment.

(3) In the above-described embodiment, the duty ratio of the voltage is controlled based on the corrected voltage command pattern at the time when a command to close the door 51 is received from the controller 25, however the invention is not limited to this. More specifically, even if a detection value fluctuates during an opening operation or closing operation of the door 51, a corrected voltage command pattern may be generated based on the detection value after the fluctuation, and the duty ratio of the voltage may be controlled based on the corrected voltage command pattern.

(4) In the above-described embodiment, the detection values output by the power-supply voltage detecting unit 2 (the set voltage values) may be incremented by 10 V, however the invention is not limited to this. Moreover, the set voltage values are discrete values in the above-described embodiment. Alternatively, the set voltage values may be continuous values. More specifically, the power-supply voltage detecting unit 2 may output actually-detected voltage values as the detected values without any change.

(5) In the above-described embodiment, the door opening-closing control unit 1 is applied to the door opening-closing driving mechanism 10 that includes the electric motor 13 that is an alternate-current brushless motor. However the invention can be applied to the door opening-closing driving mechanism 10 that includes other type of motor (for example, a synchronous motor, an induction motor or the like).

INDUSTRIAL APPLICABILITY

The invention can be widely applied as the vehicle door opening-closing control device that controls opening and closing of a vehicle door(s).

LIST OF REFERENCE NUMBERS

1 door opening-closing control unit (vehicle door opening-closing control device)
2 power-supply voltage detecting unit
3 reference voltage command pattern storage unit (reference control pattern storage unit)
4 PWM control unit
4*a* voltage command pattern generating unit (control pattern generating unit)
6 motor driving unit
13 electric motor
50 vehicle
51 door

What is claimed is:

1. A vehicle door opening-closing control device that controls opening and closing of a door of a vehicle using an electric motor, comprising:

a power-supply voltage detecting unit outputting a detection value of a power-supply voltage of the electric motor;

a reference control pattern storage unit storing a reference control pattern that indicates a voltage command value or a speed command value for the electric motor, the reference control pattern being a control pattern of the electric motor when the detection value is within a predetermined range;

a control pattern generating unit generating a corrected control pattern that is obtained by correcting the reference control pattern based on the detection value; and a PWM control unit controlling the electric motor based on the corrected control pattern, wherein the control pattern generating unit corrects the reference control pattern such that a value of the reference control pattern is reduced when the detection value is larger than a reference voltage value of the power-supply voltage, and corrects the reference control pattern such that a value of the reference control pattern is increased when the detection value is smaller than the reference voltage value.

2. The vehicle door opening-closing control device of claim 1, wherein the power-supply voltage detecting unit outputs a set voltage value as the detection value, the set voltage value is specified for each power-supply region between two adjacent voltage threshold values among a plurality of voltage threshold values.

3. The vehicle door opening-closing control device of claim 2, wherein each of the plurality of voltage threshold values has a lower voltage threshold value, which is equal to or smaller than the corresponding voltage threshold value, and a higher voltage threshold value, which is equal to or larger than the corresponding voltage threshold value, wherein a hysteresis width of each of the plurality of voltage threshold values is a voltage width from the corresponding voltage threshold value to its lower voltage threshold value, and wherein, when a detected voltage value is within the hysteresis width, the power-supply voltage detecting unit outputs, as the detection value, the set voltage value set for the power-supply region that includes a most recent voltage value from among voltage values outside the hysteresis width.

4. The vehicle door opening-closing control device of claim 1, wherein the control pattern generating unit corrects the reference control pattern by multiplying the reference control pattern by a value that is obtained by dividing the reference voltage value of the power-supply voltage by the detection value.

5. The vehicle door opening-closing control device of claim 1, wherein the power-supply voltage detecting unit outputs, as the detected value, a value based on a moving average of a voltage value.

6. The vehicle door opening-closing control device of claim 1, wherein the control pattern generating unit is configured to generate the corrected control pattern by applying a correction based on the detection valve to the reference control pattern and to store the corrected control pattern for use by the PWM.

7. The vehicle door opening-closing control device of claim 1, wherein the control pattern generating unit is configured to generate the corrected control pattern for each detection value and store the corrected control pattern to replace a prior one.

* * * * *